United States Patent [19]

Ankrom et al.

[11] 4,044,427

[45] Aug. 30, 1977

[54] COMBER ROLL

[75] Inventors: Albert M. Ankrom; John T. Vernon, both of Sanford, N.C.

[73] Assignee: Rogers Corporation, Rogers, Conn.

[21] Appl. No.: 688,640

[22] Filed: May 21, 1976

[51] Int. Cl.[2] ..... D01G 15/84

[52] U.S. Cl. ..... 19/97; 19/112

[58] Field of Search ..... 19/112–114, 19/97, 63, 98; 148/6, 11, 31.5; 428/457, 538; 51/206 R; 125/15, 18, 39, 22; 76/112; 30/346.53

[56] References Cited

U.S. PATENT DOCUMENTS

| | | | |
|---|---|---|---|
| 3,387,338 | 6/1968 | Kanai et al. | 19/114 |
| 3,597,844 | 8/1971 | Messinger | 30/346.53 |
| 3,626,921 | 12/1971 | Lane | 125/15 |
| 3,833,968 | 9/1974 | Arai et al. | 19/114 |
| 3,968,542 | 7/1976 | Hollingsworth | 19/112 |

FOREIGN PATENT DOCUMENTS

| | | | |
|---|---|---|---|
| 2,116,951 | 10/1971 | Germany | 19/98 |
| 13,572/66 | 7/1966 | Japan | 19/114 |

*Primary Examiner*—Dorsey Newton

[57] ABSTRACT

A discardable comber roll is characterized by a plastic core which supports, in a spiral groove, a card clothing wire having a wear-resistant coating thereon. The comber roll core is molded, the card clothing wire is installed thereon and the roll is thereafter post cured and balanced by removal of material from the side face or faces of the plastic core.

2 Claims, 5 Drawing Figures

COMBER ROLL

BACKGROUND OF THE INVENTION:

1. Field of the Invention

The present invention relates to the manufacture of devices for use in the open spinning of textile materials and particularly to the fabrication of comber roll heads. More specifically, the present invention relates to disposable beater rolls. Accordingly, the general objects of the present invention are to provide novel and improved methods and articles of such character.

2. Description of the Prior Art

Comber rolls, also known in the art as beater and picker rolls, used in the processing of textile materials consist of a cylindrical core having a toothed wire secured to the peripheral portion thereof. The toothed wire, known in the art as the "clothing", is spiraled about the cylinder axis. The comber rolls furnished by original textile equipment manufacturers are metallic and, because of their composition and method of manufacture, are comparatively expensive components. The service life of presently available comber rolls is frequently quite short because of wear or damage to the card clothing wire. It is, accordingly, common practice to attempt to refurbish the comber rolls. This refurbishing operation requires that the textile mill remove the roll from the machine and this is often a difficult task. The roll is thereafter renovated by removal of the card clothing wire and replacement with a new wire. Due to the difficulty of removal of the card clothing wire from the comber roll core, for reasons which will be briefly discussed below, the refurbishing of comber rolls is a time consuming and expensive task which is customarily performed by specialized contractors rather than the textile mill.

As noted above, the comber rolls supplied by original equipment manufactures comprise a cylindrically shaped core, which has been machined from metal, and a toothed card clothing wire secured in a spiral arrangement on the peripheral portion of the core. The typical method of mounting the wire on the core is to cut a spiral groove in the periphery of the core and wind the toothed wire in this groove under tension. Thereafter, the wire is secured in place by any of several methods which can generally be described as "caulking". Thus, by way of example, the card clothing wire may be secured in the groove on the core by deforming the metal of the periphery of the core against the wire after it has been positioned in the spiral groove. Should the card clothing wire become damaged, thus necessitating that the comber roll be "re-clothed", the spiral groove in the periphery of the core will typically be turned off, a new groove cut in the core and the core thereafter rewired. As will be obvious, each time a comber roll is re-clothed its diameter is reduced and this fact limits both the number of possible re-clothings and has a deleterious effect on the ability to adjust the position of the comber roll when installed in the textile machinery.

Comber rolls are also known wherein a filler strip is mounted in the spiral groove on the core and the card clothing wire is, in turn, either held in the filler strip or between the turns of the strip which self-defines a second spiral groove. If the card clothing wire is seated against the periphery of the core between turns of the filler strip, the wire will be held on the core by means of upsetting the filler strip. While this type of comber roll has certain advantages insofar as the useful service life of the part is concerned, it is generally not favored since manufacturing problems, which will not be discussed herein, usually preclude the manufacture of an end product wherein the card clothing wire projects a uniform distance from the axis of the core. Additionally, problems have been encountered in securely fastening the ends of the filler strip to the core in a manner in which permits the removal thereof without damaging the core during a refurbishing operation.

The above generally discussed comber roll designs are exemplary of the state of the art only and those skilled in the art will understand that numerous other designs have been tried. All prior approaches to comber roll design have been characterized by the use of a machined metal core and, regardless of the manner in which the card clothing wire was retained on the core, expensive and time consuming re-clothing. Additionally, use of a machined metal core has resulted in a product which is initially comparatively expensive and which is also comparatively heavy. The weight of prior art comber rolls, in turn, has resulted in a degree of wear on the driving parts, including drive shaft bearings, which the industry has long sought to reduce. Also, the weight of prior comber rolls has limited the rotational speed which could safely be imparted thereto. The metal construction of the prior art has additionally made it difficult to balance the parts. All of the above briefly discussed problems have resulted in generally unacceptable machine down time and, taking down time and both initial and comber roll refurbishing cost into account, a significant economic penalty.

SUMMARY OF THE INVENTION

The present invention overcomes the above briefly discussed and other deficiencies and disadvantages of the prior art by providing a novel and improved comber roll characterized by the use of low cost materials and techniques. The design and method of manufacture of comber rolls in accordance with the invention results in a component which may, without an econimic penalty, be discarded rather than refurbished upon wear or damage to the card clothing wire. Thus, pursuant to the present invention, the comber roll generally cylindrical core is molded from a plastic having appropriate characteristics of toughness and chemical resistance. As molded, the comber roll core has a spiral card clothing wire receiving groove. Additionally, as an added benefit incident to the use of a plastic material as the comber roll core, the end faces of the core may be easily machined to balance the part and also to define notches in the side faces thereof which will induce air currents for the purpose of directing debris away from the comber roll.

Also in accordance with the present invention, the card clothing wire is formed from steel and, subsequent to formation, is provided with an extremely hard wear resistant coating. This coating, which may be comprised of diamond dust, significantly lengthens the service life of the wire by reducing the effects of wear and abrasion. The coated wire is forced into the groove in the plastic core, in the manner known in the art, and the comber roll is thereafter subjected to post curing which results in the plastic material settling around the wire whereby the card clothing wire will firmly be held in position both by friction and as a result of the flowing of the plastic during the post cure step. Additionally, since the comber roll of the present invention is a disposable item, one or both ends of the card clothing wire may be secured to the core by means of pins thereby substantially obviating the possibility of the wire becoming lose and entering the machine and damaging the wire on other adjacent comber rolls.

Brief Description of the Drawing:

The present invention may be better understood and its numerous objects and advantages will become apparent to those skilled in the art by reference to the accompanying drawing wherein like reference numerals refer to like elements in the several figures and in which.

Description of the Preferred Embodiment

The first step in the fabrication of a comber roll in accordance with the present invention consists of the production of the core. The core material will be selected commensurate with the physical and chemical requirements of the operating environment. Thus, the core material must have sufficient strength and toughness to withstand the mechanical stresses to which it will be subjected while being driven at a high speed and, in addition, the core material must not degrade in the presence of the finishing materials employed on fibers. Further, in order to permit economic manufacture, the core material must be available in powder form and be capable of being molded into the desired shape. Also, subsequent to molding, the core must be susceptible to maintaining. Although not limited thereto, experience has shown that plastic materials such as that commercially available under the name "Delrin" and nylon may be employed; "Delrin" having been found to be particularly well suited for use in the present invention. The core molding step, wherein the plastic powder is formed into the desired shape as indicated at 10 in FIG. 5 and the resulting core is indicated generally at 12 in FIGS. 1–4.

Figure 1:
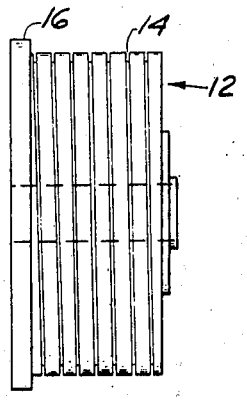
FIG. 1 is a front elevation view of a comber roll core in accordance with a first embodiment of the present invention.
Figure 2:
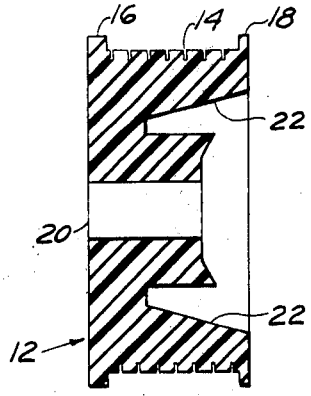
FIG. 2 is a cross-sectional front elevation view of a comber roll core in accordance with a second embodiment of the invention.
Figure 3:
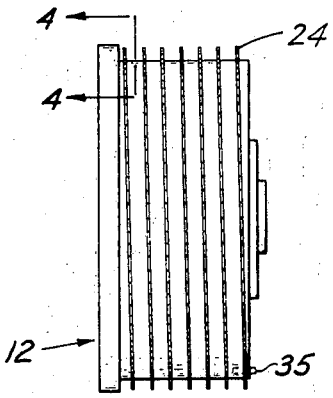
FIG. 3 is a front elevation view of the core of FIG. 1 with the card clothing wire installed thereon.

Core 12, in addition to being formed of plastic, is characterized by a spiral peripheral groove 14. Groove 14 is preferably formed during the core molding step but could also be machined in a separate operation. Groove 14 is commensurate in width with the thickness of the card clothing wire which will ultimately be installed therein. Core 12, may, but will not necessarily, have a raised rim portion extending inwardly from one or both edges thereof. In the embodiment of FIG. 1 a rim 16 is depicted at the left side only of the core. In the embodiment of FIG. 2, rims 16 and 18, of different widths, are respectively provided at the opposite edges of the core. The core will, of course, also be provided with an axial passage, either regular or irregularly shaped, as indicated at 20 for purposes of permitting the core to be installed on a rotary drive shaft.

Referring particularly to FIG. 2, the core 12 may also be either molded with or subsequently machined to define notches, such as indicated at 22, on one or both faces thereof. The notches, if present, are for the purpose of setting up air currents to blow debris away from the comber roll during operation. The notches 22, if present, will be of equal size and equally spaced about the core so as to insure the balance of the part.

Figure 4:
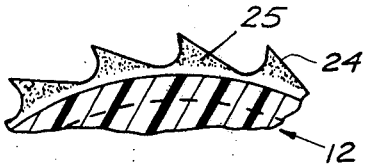
FIG. 4 is a partial cross-sectional side elevation view on an enlarged scale, of the comber roll of FIG. 3 with the card clothing wire installed.
Figure 5:
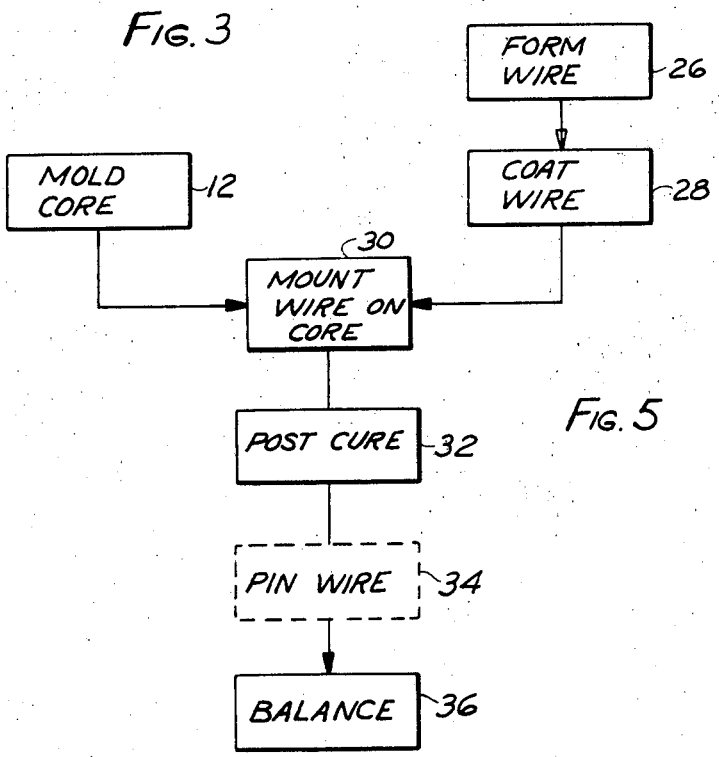
FIG. 5 is a flow diagram depicting the manufacturing process for the comber roll of FIG. 3.

Referring now to FIG. 4, the card clothing wire is indicated at 24. Wire 24 will be formed from steel, typically by stamping, so as to have a pattern of teeth as required for the particular open end spinning machine on which the comber roll is to be employed. The step of forming the card clothing wire is indicated in FIG. 5 at 26. The wire 24 will typically be of constant cross-section; i.e., the wire will be in the form of a flat strip having the teeth in one edge thereof.

Subsequent to its formation, the card clothing wire is provided with a wear-resistant coating 25 as indicated at step 28 on FIG. 5. The wear-resistant coating 25 will typically comprise diamond dust or particles held in a binder or matrix. The method of applying the wear-resistant coating 25 to wire 24 is commensurate with the state of the art, does not comprise part of the present invention and will not be discussed herein.

When fabrication of wire 24 has been completed, the wire will be mounted on core 12, as indicated at step 30, by forcing the wire into groove 14. Because of the relative widths of the groove and wire, there will be a tight fit of the wire in the groove and the wire will be retained in position by friction. Thereafter, the comber roll will be subjected to an annealing step wherein the plastic is post cured. During the annealing step the plastic will "settle" around the wire thus further retaining the card clothing wire 24 in groove 14.

It is often deemed desirable to pin one end of wire 24 into groove 14 as indicated by optional step 34 in FIG. 5. A pin is shown, greatly exaggerated in size, at 35 in FIG. 3. The provision of the pin will insure against any "crawl" of wire 24 during use. The other end of wire 24; i.e., the unpinned end; will typically be held in groove 14 by a friction fit.

The final step in the manufacture of a comber roll in accordance with the present invention consists of balancing the part as indicated at 36 in FIG. 5. The balancing is performed in the conventional manner with cuts being made in the side face or faces of the core 12 to remove material as necessary to achieve the balanced condition.

As will now be obvious to those skilled in the art, the present invention consists of a disposable comber roll, and its method of manufacture, having the advantages of reduced cost of manufacture, lighter weight when compared to the prior art and greater ease of balancing. The greater ease of balancing results from both the use of easily machinable plastic material for the roll core and because of the lighter weight of the core when compared to prior art rolls. Comber rolls in accordance with the invention are also characterized by ease of replacement and, because of this ease of replacement and the greater service life expectancy of the part, less machine down time. Should one of the rolls of the present invention become damaged or worn, it may be replaced merely by pressing the old roll off the drive shaft, pressing the new roll on and placing the comber roll head which includes the roll back in the open end spinning machine. Thus, a position with a damaged comber roll head can be back in production within minutes. With regard to the life expectancy, the use of the diamond coated wire, singly and in combination with the ability to drive the roll at higher speeds, produces longer life at a high performance level and thus results in better quality yarn. A particularly significant economic advantage results from the fact that the textile plant operator does not have to inventory comparatively expensive metal comber rolls to cover those being refurbished. A further important economic advantage incident to use of the present invention resides in the fact that the entire comber roll head has a greater life expectancy due to less wear on bearings and other driving parts as a consequence of the lighter weight of the comber rolls of the present invention.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. A comber roll comprising:

a molded plastic core, said core having a spirally grooved cylindrical portion of constant diameter, said core further having an axial passage for receiving a rotary drive shaft and a pair of parallel end faces, said end faces being oriented transversely to the axis of said core cylindrical portion;

a plurality of equally spaced notches in at least a first of said core end faces, said notches and the core segments therebetween defining vanes to establish air currents for directing debris away from said roll;

a flat card clothing wire positioned on edge in said groove in said core cylindrical portion, said wire having regularly spaced teeth in its outwardly disposed edge; and a wear-resistant coating on at least the toothed portion of said wire, said coating including diamond particles.

2. The apparatus of claim 1 further comprising:

a pin passing through a portion of said core and said wire adjacent a first end thereof, said pin retaining said first end of said wire at a predetermined position in said groove.

* * * * *